United States Patent [19]

Okayama

[11] Patent Number: 4,986,482

[45] Date of Patent: Jan. 22, 1991

[54] YARN JOINING CONTROL DEVICE IN AN AUTOMATIC WINDER

[75] Inventor: Tomoaki Okayama, Joyo, Japan

[73] Assignee: Murata Kikai Kabushiki Kaisha, Kyoto, Japan

[21] Appl. No.: 416,666

[22] Filed: Oct. 3, 1989

[30] Foreign Application Priority Data

Oct. 7, 1988 [JP] Japan ..... 63-251933

[51] Int. Cl.[5] ..... B65H 54/26

[52] U.S. Cl. ..... 242/35.6 OR; 242/35.5 OR; 242/36

[58] Field of Search ..... 242/35.6 R, 35.5 R, 242/35.5 A, 36, 37 R

[56] References Cited

U.S. PATENT DOCUMENTS 4,773,606 9/1988 Ohashi ..... 242/35.6 R

*Primary Examiner*—Stanley N. Gilreath

*Attorney, Agent, or Firm*—Spensley Horn Jubas & Lubitz

[57] ABSTRACT

A yarn joining control device for an automatic winder of the type having yarn joining-disablement display device which display a failure of yarn joining operation in case where the yarn operation fails predetermined times, in which a carriage moves along a plurality of winding units and is provided with detection devices, a converting device for the yarn joining-disablement display device, and a memory device for storing the detected results.

11 Claims, 5 Drawing Sheets

YARN JOINING CONTROL DEVICE IN AN AUTOMATIC WINDER

FIELD OF THE INVENTION

The present invention relates to a yarn joining control device in an automatic winder.

RELATED ART STATEMENT

In an automatic winder having a number of winding units disposed parallel with each other, each unit is provided with an automatic yarn joining device, or there is a yarn joining carriage moving between a plurality of units.

In such a winder provided with automatic yarn joining devices, a yarn is forcibly cut, in order to remove a defective part of the yarn during winding, or yarns are not present in a spinning bobbin on the feed side or yarn cutting occurs for other causes. In any of these cases, the winding operation once stops, namely, a drum for driving a winding package stops. In the winder provided with a yarn joining device on each unit, the joining operation is immediately initiated, a yarn end on the winding side and a yarn end on the feed side are joined by said yarn joining device. In the winder having yarn joining carriage which moves along the plurality of units, a joining command signal is mechanically or electrically issued from a unit involving a yarn cut, and the yarn joining carriage during running stops at a position of the winding unit which has a joining command to effect yarn joining.

In the winders or winding units of any type as described, the yarn joining operation is carried out, and if the yarn joining is succeeded, the winding operation is restarted. However, where the yarn joining fails and the joining is not succeeded even after a predetermined number of times of yarn joining operations, joining disablement is displayed on yarn joining disablement display means of the winding unit. When an operator finds a winding unit which stops due to the joining disablement from the aforesaid display, the operator performs processing work to remove the cause of joining disablement to overcome the display of joining disablement. Then, the yarn joining operation is automatically restarted.

As described above in prior art, the winding operation can be restarted only after the joining disablement unit has been corrected by hands of the operator. Accordingly, the winding operation remains stopped till the operator finds the unit after the joining disablement has been displayed. A supply of a spinning bobbin to the winding unit is not affected if a set number of yarn joining operations fail and if no spinning bobbins are stored for feeding to the winding unit, resulting in a joining disablement where a bobbin is supplied after the joining disablement has been displayed, if yarn joining operation is further carried out, yarn joining is sometimes succeeded.

If the yarn joining operation in the winding unit which can possibly perform yarn joining is stopped, the working efficiency of the unit is deteriorated.

For settling the aforesaid problems, in an automatic winder of the type in which a carriage moves along a plurality of winding units and having a yellow button projected when the yarn splicing operation fails a predetermined number of times, as disclosed in a yarn joining control device in an automatic winder of a prior application (Japanese patent application No. 62-77212 (Laid-open No. 63-242869)) filed by the present applicant, said carriage comprises a first photoelectric tube sensor for detecting the projection of a yellow button to stop the carriage, an arm for pushing-in the yellow button in response to the detection by said first photoelectric tube sensor, and a second sensor for detecting a yarn drawn out from the side of a package during the yarn joining operation effected after depression of the yellow button. The second sensor is mechanically constituted by a feeler at an end of an arm turnable about a fixed shaft and a proximity switch which is turned on and off according to the magnitude of movement of the feeler. On the side of the winding unit is provided an auxiliary button which is moved in and out according to the presence or absence of yarn on the package side other than the yellow button on the side of the winding unit. When the yarn on the package side is not detected by the second sensor, the auxiliary button is operated to block the thereafter automatic yarn joining operation. After manual correction by the operator, the auxiliary button is reversely operated to render the thereafter automatic joining possible.

According to the yarn joining control device in the automatic winder as described above, the winding unit stops because of the joining disablement, but in the next yarn joining operation, yarn joining command is automatically issued by the carriage for the unit which has a possibility of succeeding joining. Therefore, winding is restarted without waiting the processing by the operator, thus enhancing the working efficiency of the winder. In addition, an automatic yarn joining command is not issued to a unit which has a high probability of failure of joining, and accordingly, a useless attempt of a yarn joining operation can be prevented.

However, in the yarn joining control device in the automatic winder as described above, only the drawing of the yarn on the package side is detected by mechanical means in the form of a yarn detecting feeler, and therefore, judgement whether or not joining of upper yarn and lower yarn has been succeeded cannot be made. Furthermore, when the upper yarn on the package side is fine, i.e., low yarn tension exists, it is difficult to balance the feeler. Therefore, non-presence of yarn is sometimes judged to effect malfunction. Moreover, mechanical means is used for detection as described above, and therefore, the mechanism becomes complicated, thus leaving many points to be improved.

OBJECT AND SUMMARY OF THE INVENTION

An object of the present invention is to provide a yarn joining control device in an automatic winder which can perform yarn joining operation with high efficiency in the automatic winder.

For achieving the aforesaid object, the present invention provides an automatic winder of the type having joining-disablement display means which displays a failure of yarn joining operation in case where such yarn joining operation fails a predetermined number of times and in which a carriage moves along a plurality of winding units, said carriage being provided with first detection means for detecting the display state of the joining disablement display means to stop the carriage; means for converting said joining-disablement display means to a non-display state in accordance with the detection of said first detection means; second detection means for detecting said joining-disablement display means returned to a display state as a result of the failure of a predetermined number of times of yarn joining operation effected after said conversion; and memory means for storing the joining-disablement state by detection of said second detection means to impede said conversion processing when said carriage again arrives at the winding unit.

When the first detection means detects the display state of the joining-disablement display means to stop the carriage at the position of the winding unit in the display state, the joining-disablement display means is converted to the non-display state in response to the afore-said detection on the carriage side. Thereby, the yarn joining operation is forcibly started in the winding unit.

In the case where the yarn joining operation fails a predetermined number of times after the yarn joining operation has been restarted, the joining disablement occurs in the corresponding winding unit and the joining-disablement display means returns to the display state.

The second detection means detects its display state. The memory means stores the joining disablement state in response to such detection, and the carriage travels toward the other winding unit.

When the carriage again arrives at the winding unit in the joining-disablement state, the conversion from the display state of the joining-disablement display means to the non-display state in the unit is impeded in accordance the aforesaid memory. Accordingly, the carriage is not stopped at the unit, and the yarn joining operation is not effected.

If the joining-disablement is once stored as described above, the travelling carriage is not stopped even it again arrives at the winding unit till the joining-disablement state has been overcome by the operator's processing but can pass therethrough. Accordingly, a useless attempt of a yarn joining operation is not effected to render possible efficient control of yarn joining operation.

DETAILED DESCRIPTION OF PREFERRED EMBODIMENTS

An embodiment of the present invention will be described hereinafter with reference to the accompanying drawings.

Figure 1:
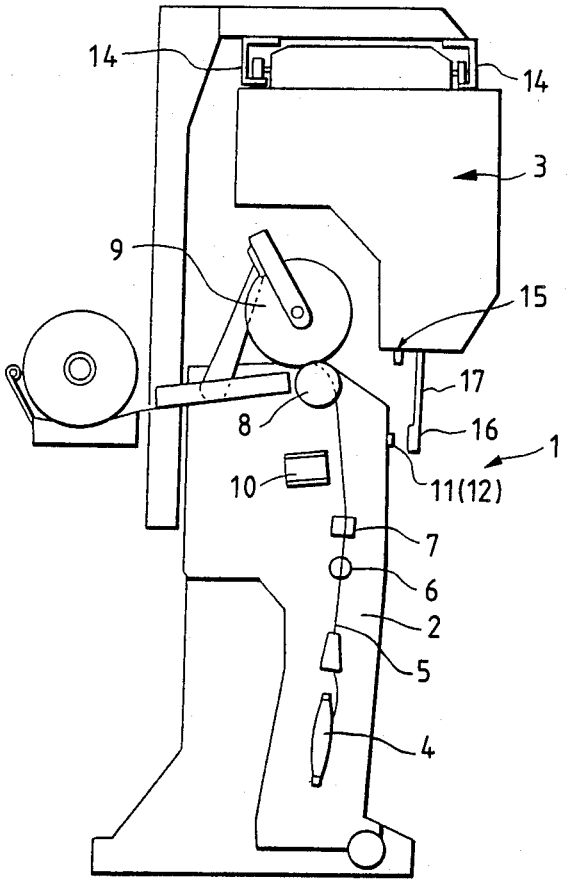
FIG. 1 is a side view showing an automatic winder in an embodiment of the present invention.

As shown in FIG. 1, an automatic winder 1 has a plurality of winding units 2 arranged parallel with each other, and a working carriage 3 travelling along the winding units 2 is provided. In case of the present embodiment, a carriage 3 with an automatic doffer housed therein is used as the aforesaid working carriage. The winding unit 2 is to wind a yarn 5 drawn out of a yarn feed bobbin 4 in a set amount onto a winding package 9, which is rotated by a traverse drum 8, via a tensioner 6, a slub catcher 7 and the like. Each unit is provided with a yarn joining device 10 in which a yarn end on the side of a bobbin 4 and a yarn end on the side of a package 9 are joined by means which will be described later. The winding unit 2 is further provided at the front portion with joining-disablement display means 12. This joining-disablement display means 12 comprises a yellow button 11 in this embodiment. When the yarn joining fails despite predetermined times of yarn joining operation, the yellow button 11 is projected forwardly to assume the display state. During the time when the yellow button 11 is at a projected position, the winding by the winding unit remains stopped, and when the button 11 is depressed, the yarn joining operation is automatically restarted. The working carriage 3 travelling along the units is suspended and supported on ceilings 14 and 14 through wheels and reciprocates or circulates along the winding units. While in the present embodiment, the carriage 3 comprises an automatic doffing carriage, it is to be noted that other carriages, for example, a bobbin supply carriage which travels along the rails on the floor below the units to supply spinning bobbins to the units or a movable body which moves along the units.

Figure 2:
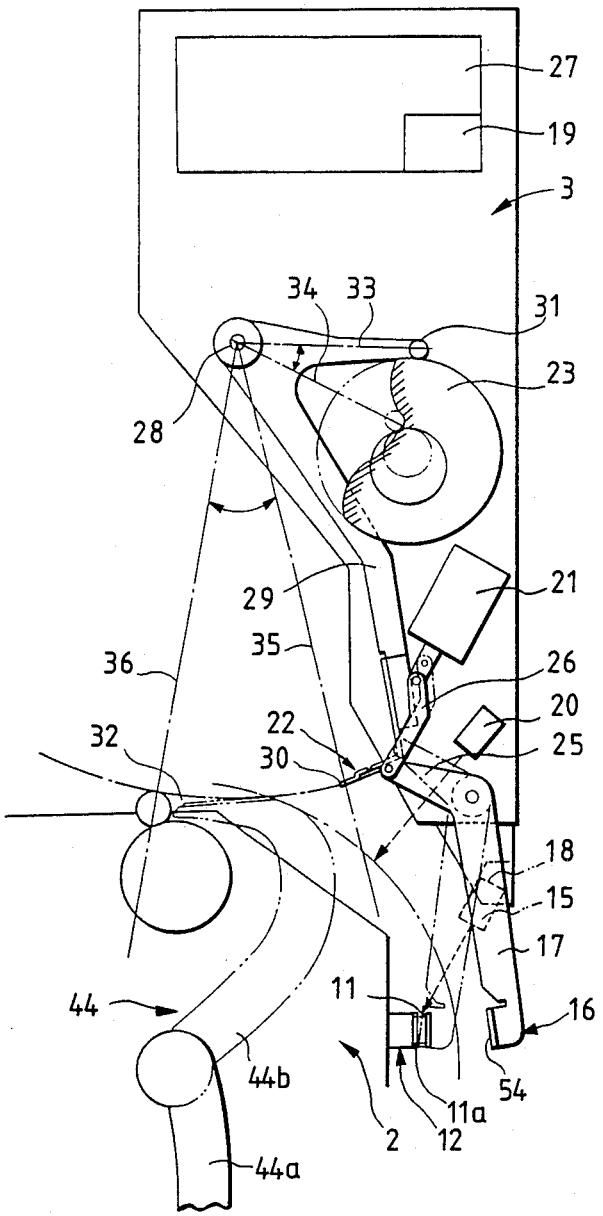
FIG. 2 is a side view showing parts of the embodiment of the present invention shown in FIG. 1.
Figure 3:
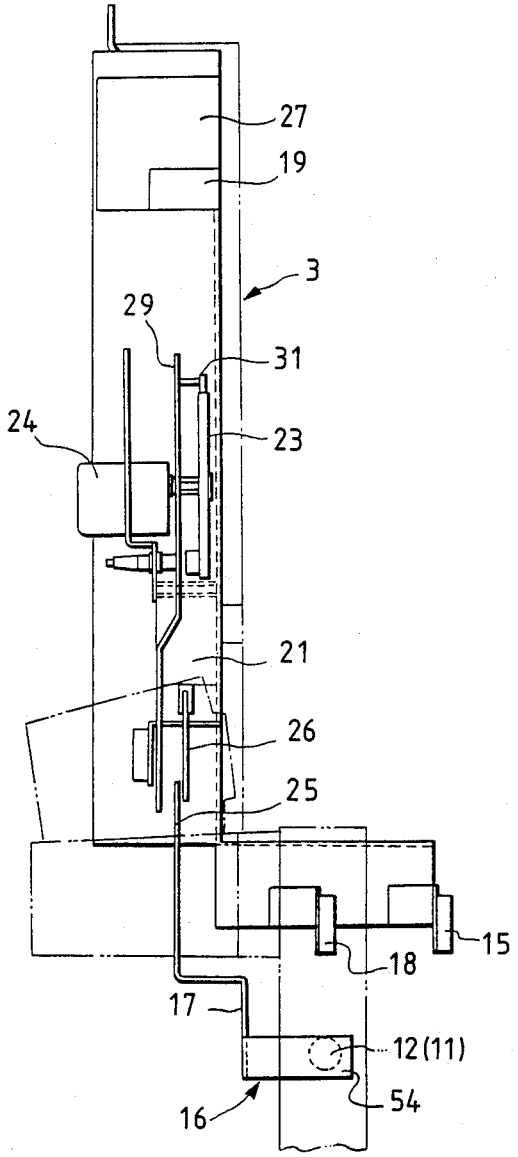
FIG. 3 is a front view showing parts of an embodiment of the present invention.

As shown in FIGS. 2 and 3, the carriage 3 is provided with first detection means 15, means 16 for converting the joining disablement display means to a non-display state, second detection means 18, memory means 19, third detection means 20 for monitoring the state of yarn joining operation, a solenoid 21 for actuating said conversion means 16, a beater device 22 for peeling-off a yarn end from the package side when yarn joining takes place, a cam 23 for actuating the beater device 22, a motor 24 for rotating the cam 23, and the like. On the other hand, the winding unit 2 is provided with joining-disablement display means 12 comprising a yellow button 11, and a suction mouth 44 for guiding yarn to the joining device 10 shown in FIG. 1.

The first detection means 15 is a sensor for detecting the display state of the joining-disablement display means 12 to stop the carriage 3 at the winding unit 2 in that state. The means 15 comprises a reflective type photoelectric tube sensor.

The conversion means 16 has a press member 54 for pushing-in a yellow button 11 mounted at the lower end thereof and a lever 25 integral with an arm 17, said lever 25 being connected to a rod 26 driven by a solenoid 21, whereby the yellow button 11 is depressed by the press member 54 to thereby convert the joining-disablement display means 12 from its display state to an non-display state.

The second detection means 18 is a sensor in which in the winding unit 2 in the state where the carriage 3 stops, where a predetermined number of times (for example, three times) of yarn joining operation are completely failed, and when the joining-disablement display means 12 returns to the display state from the non-display state because of the joining disablement, said display state is detected. A reflective type photoelectric tube sensor is used in this embodiment.

The memory means 19 is provided so that the joining disablement state is stored in response to the detection of the second detection means 18, and when the carriage 3 again arrives at the winding unit 2 in the joining-disablement state after the carriage 3 has travelled toward the other winding units, conversion of the display state with respect to the joining-disablement display means 12 to the non-display state is impeded whereby the carriage 3 is not stopped at the units 2 and the yarn joining operation is not effected. The memory means 19 is incorporated into a control device 27 such as a microcomputer or the like in the present embodiment.

The third detection means 20 is provided to detect a suction mouth 44 provided on the side of the unit 2. In the case where the suction mouth 44 is turned and moved toward the package side for a predetermined period of time, within 3 seconds in this embodiment, this is detected to know that joining fails. A reflective type photoelectric tube sensor is used in this embodiment.

The beater device 22 is the device for facilitating the drawing of a yarn end on the package side. The device has a contact member 30 mounted on an arm 29 turnable about a fixed shaft 28 and a cam follower 31. The contact member comes into contact with the surface of a yarn layer when the package is reversed to peel off the yarn end from the yarn layer to cause the yarn end to suck toward a suction port 32 of the suction mouth 44. The contact member may be formed of rubber, synthetic resin or metal and has the width substantially over the whole area of the bus line of the package.

The cam follower 31 comes into contact with the cam 23, follows the clockwise rotation of the cam 23 and moves from a position indicated by the phantom line 33 to a position indicated by the phantom line 34 whereby the contact member 30 is moved from a position indicated by the phantom line 35 to a position indicated by the phantom line 36.

The cam 23 is connected to a drive shaft of the motor 24, and by a full rotation thereof, a series of processes in connection with the yarn joining operation is executed.

As the joining-disablement display means 12, the yellow button 11 is used as mentioned above, which is displayed at the time of joining-disablement. The button 11 is in the position depressed into the position 11*a* indicated by the phantom line during normal winding. When the yarn joining has not succeeded despite a predetermined number of times of yarn joining operation, the button is projected to the position 11 indicated by the solid line. If the projected button 11 is forcibly depressed, the yarn joining operation is again started. The button 11 has a light reflective surface 11*a* in the outer periphery thereof colored with yellow so that it may be detected by the photoelectric tube sensor 15 which will be described later.

The operation of the apparatus constructed as described above will be explained with reference to FIGS. 2, 3 and 4.

Figure 4A:
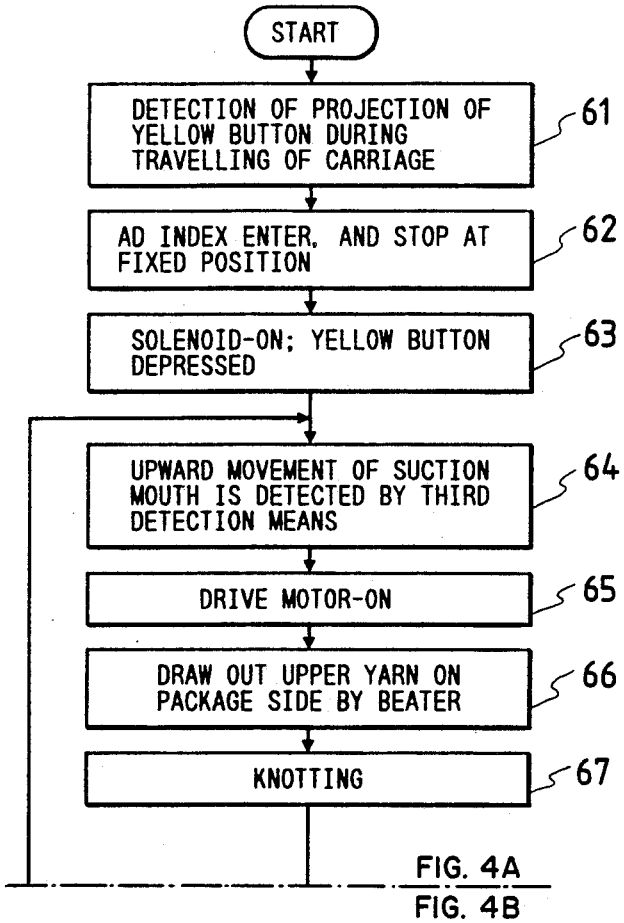
FIG. 4 is a flow sheet showing a procedure of the control of yarn joining operation.
Figure 4B:
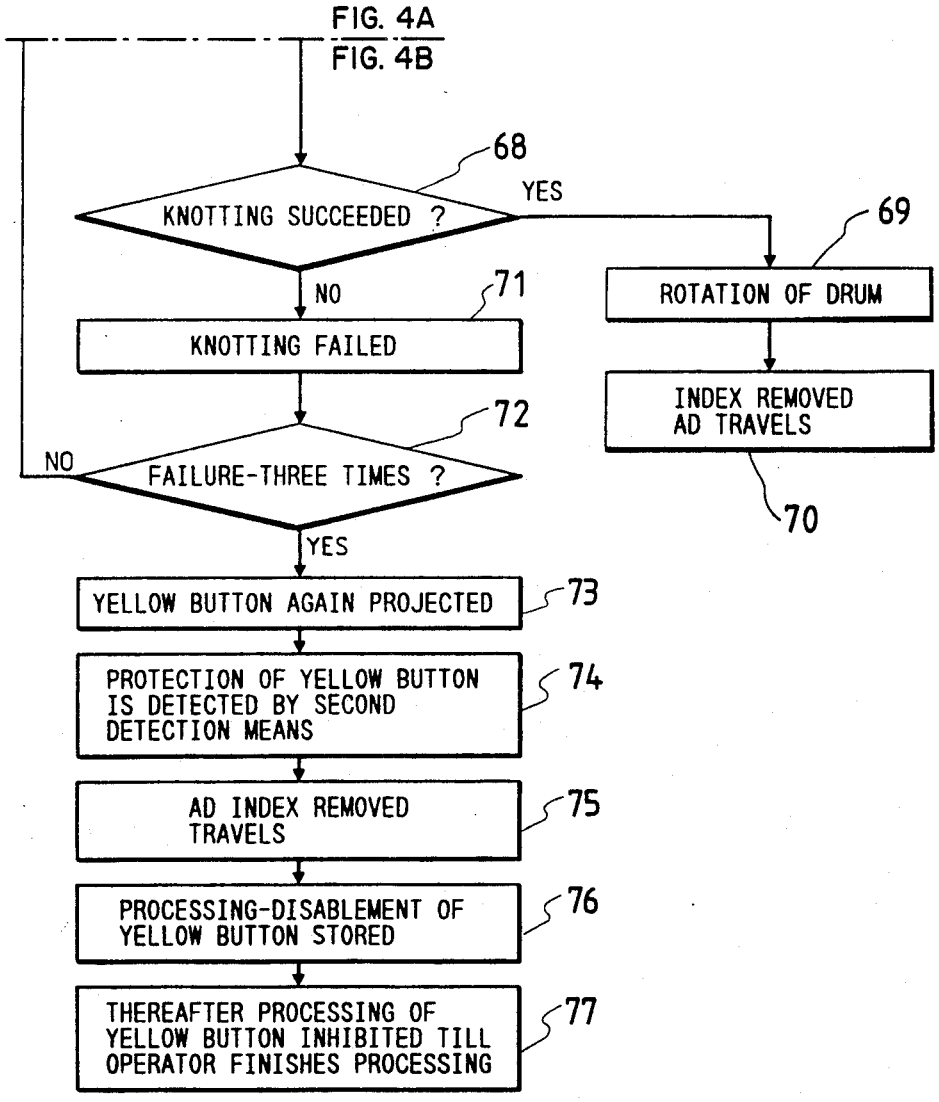

The winding unit 2 of which winding operation stops with the yellow button 11 projected is detected by the first detection means 15 on the side of the carriage 3 (step 61). Then, positioning in the winding unit 2 indexed from INDEX (reference position) of AD (Automatic Doffer) is effected, and immediately, the running motor above the carriage 3 is reduced in speed and the carriage 3 stops at a predetermined position (step 62). The stop position at that time is located so that the end of the yellow button 11 and the press member 54 are opposed to each other as shown in FIG. 3. When the carriage 3 stops, the solenoid 21 is actuated so that the conversion means 16 is turned counterclockwise from the stand-by position through the lever 25 and the rod 26, an the press member 54 depresses the yellow button 11 as indicated by the phantom line (step 63) to convert the joining-disablement display of the joining-disablement display means 12 to the non-display. As the yellow button 11 depresses, the drive mechanism of the yarn joining device within the unit 2 is turned on to start the yarn joining operation. That is, when the suction mouth 44 is detected by the third detection means 20 when the suction mouth 44 for drawing the yarn end on the package side is turned counterclockwise from the stand-by position 44*a* indicated by the solid line to the operating position 44*b* (step 64), the drive motor 24 shown in FIG. 3 is turned on (step 65). The cam 23 rotates as the motor 24 drives, the contact member 30 of the beater device 22 moves toward the package as the cam follower 31 in contact with the peripheral portion of the cam 23, and when the package is reversed, the contact member 30 comes into contact with the yarn layer to facilitate drawing of yarn end and drawing of a yarn on the package side is effected (step 66). The yarn end is sucked against the suction port 32 of the suction mouth 44, and the suction mouth 44 is reversed to start yarn joining between the upper and lower yarns, that is, knotting (step 67). Judgement whether or not knotting has succeeded (step 68) is executed in the procedure such that the turning of the suction mouth 44 from the stand-by position 44*a* to the operating position 44*b* within (for example, about 1.5 seconds) a predetermined period of time (in the present embodiment, about 2.5 seconds) after the cam follower 31 has been returned to the start position upon full rotation of the cam 23 is detected by the third detection means 20, this means NO, i.e., failure of knotting (step 71), whereas if the suction mouth 44 is detected by the detection means 20 after passage of a predetermined time, it means YES, i.e., rotation of the drum (step 69). In case of the failure of knotting (step 71), judgement whether or not times of failure are three is made (step 72). If not three times (NO), the execution is again returned to the step 64 to detect the suction mouth 44. If three times (YES), joining-disablement is judged. The yellow button 11 is again projected (step 73), and a display of joining-disablement is effected by the joining-disablement display means. As shown in FIG. 4, the projection of the yellow button 11 is detected by the second detection means 18 (step 74). AD INDEX is removed, that is, positioning of stopping the carriage 3 is released, and the carriage 3 starts travelling toward the next unit (step 75). At this time, the processing-disablement by the yellow button, that is, the joining-disablement in the unit is stored by the memory means 19 provided on the carriage 3 (step 76). If the joining-disablement is once stored as described above, the operator performs the process capable of doing yarn joining to depress the yellow button 11 (step 77), until such time the carriage 3 is not stopped even if it again arrives at the same unit, and the yarn joining operation is not effected. Accordingly, a useless attempt of performing the yarn joining operation in the unit in the joining-disablement state can be omitted, and the control of the efficient joining operation may be done.

The present invention has the effect that the control of the yarn joining operation in the automatic winder is effected with high efficiency.

What is claimed is:

1. In an automatic winder of the type having yarn joining-disablement display means which displays a failure of yarn joining operation in case where such yarn joining operation fails a predetermined number of times and in which a carriage moves along a plurality of winding units, a yarn joining control device characterized in that said carriage is provided with:

first detection means for detecting the display state of the joining-disablement display means to stop the carriage;

means for converting said joining-disablement display means to a non-display state in accordance with the detection of said first detection means;

second detection means for detecting said joining-disablement display means returned to a display state as a result of the failure of a predetermined number of times of yarn joining operation effected after converting said joining-disablement display means to a non-display state; and memory means for storing the joining-disablement state by detection of said second detection means to impede said converting of said joining-disablement display to a non-display state when said carriage again arrives at the winding unit.

2. The yarn joining control device as claimed in claim 1, wherein said joining-disablement display means is a button which may be projected forwardly to assume display state and has a light reflective surface in the outer periphery thereof.

3. The yarn joining control device as claimed in claim 2, wherein said means for converting the joining-disablement display means comprises an arm having a press member for pushing-in the button at an end thereof and driven by a solenoid.

4. The yarn joining control device as claimed in claim 1, wherein the automatic winder has a package side and wherein a third detection means is further mounted on the carriage to detect a suction mouth provided on the side of the unit so that it is detected to know that yarn joining fails in the case where the suction mouth is turned and moved toward the package side for a predetermined period of time.

5. In an automatic winder provided with a plurality of winding units, each winding unit provided with a display device having a first display state and a second display state, the second display state being displayed upon a predetermined number of unsuccessful yarn joining operations performed in the winding unit associated with the display device, the improvement comprising a carriage movable adjacent the winding units wherein the carriage comprises:

a first detector for detecting the second display state of the display device of one of the winding units;

means operable for converting the display device of one of the winding units from the second display state to the first display state upon detection of the display device of the winding unit being in the second display state;

a second detector for detecting a predetermined number of operations of converting the display device of one of the winding units from the second display state to the first display state;

means for recording indicia indicating a detection of the predetermined number of operations of converting the display device of one of the winding units from the second display state to the first display state; and means for impeding the converting operation on the display device of the winding unit for which a detection of the predetermined number of converting operations occurred.

6. An automatic winder as claimed in claim 5, wherein the carriage further comprises means for moving the carriage adjacent the winding units.

7. An automatic winder as claimed in claim 5, wherein the display device comprises an indicator having two positions and wherein the first display state corresponds to one of the two indicator positions and the second display state corresponds to the other of the two indicator positions.

8. An automatic winder as claimed in claim 8, wherein the means operable for converting the display device comprises means operable for transferring the indicator from one position to the other position.

9. An automatic winder as claimed in claim 5, wherein the means for recording comprises a memory device disposed on the carriage.

10. In an automatic winder provided with a plurality of winding units, each winding unit provided with a display device having a first display state and a second display state, the second display state being displayed upon a predetermined number of unsuccessful yarn joining operations performed in the winding unit associated with the display device, the improvement comprising:

a first detector for detecting the second display state of the display device of one of the winding units;

means operable for converting the display device of one of the winding units from the second display state to the first display state upon detection of the display device of the winding unit being in the second display state;

a second detector for detecting a predetermined number of operations of converting the display device of one of the winding units from the second display state to the first display state;

means for recording indicia indicating a detection of the predetermined number of operations of converting the display device of one of the winding units from the second display state to the first display state; and means for impeding the converting operation on the display device of the winding unit for which a detection of the predetermined number of converting operations occurred.

11. An automatic winder as claimed in claim 10, further comprising a carriage movable adjacent the winding units, wherein the first and second detectors are disposed on the carriage and wherein the means for recording comprises a memory device disposed on the carriage.

* * * * *